US006179068B1

(12) United States Patent
West

(10) Patent No.: US 6,179,068 B1
(45) Date of Patent: Jan. 30, 2001

(54) DIRECTIONAL DRILLING APPARATUS

(75) Inventor: Gregory Donald West, Auckland (NZ)

(73) Assignee: Flexidrill Limited, Auckland (NZ)

( * ) Notice: Under 35 U.S.C. 154(b), the term of this patent shall be extended for 0 days.

(21) Appl. No.: 09/435,994

(22) Filed: Nov. 8, 1999

Related U.S. Application Data

(63) Continuation of application No. PCT/NZ98/00055, filed on May 8, 1998.

(30) Foreign Application Priority Data

| | | |
|---|---|---|
| May 8, 1997 | (NZ) | 314769 |
| May 28, 1997 | (NZ) | 314938 |
| Mar. 27, 1998 | (NZ) | 330080 |
| May 3, 1999 | (NZ) | 335555 |

(51) Int. Cl.[7] ..... E21B 19/08; E21B 7/02
(52) U.S. Cl. ..... 175/62; 175/162; 173/185
(58) Field of Search ..... 175/61, 62, 73, 175/122, 162, 19; 173/157, 154, 27, 185, 184, 28, 42, 190, 44, 7, 152; 299/31

(56) References Cited

U.S. PATENT DOCUMENTS

| | | | | |
|---|---|---|---|---|
| 3,061,287 | * | 10/1962 | Robbins | 299/31 |
| 3,640,573 | * | 2/1972 | Safar | 299/31 |
| 4,099,579 | * | 7/1978 | Stormon | 173/28 |
| 4,694,913 | * | 9/1987 | McDonald et al. | 175/61 |
| 4,858,700 | * | 8/1989 | Shafer | 173/185 |
| 4,953,638 | * | 9/1990 | Dunn | 175/73 |
| 5,070,948 | * | 12/1991 | Malzahn et al. | 175/19 |
| 5,226,488 | | 7/1993 | Lessard et al. | 175/61 |
| 5,242,026 | * | 9/1993 | Deken et al. | 175/19 |
| 5,341,887 | * | 8/1994 | Deken et al. | 175/62 |
| 5,469,155 | | 11/1995 | Archambeault | 340/853.4 |
| 5,592,993 | * | 1/1997 | Parish, II et al. | 175/162 |
| 5,678,642 | * | 10/1997 | Briggs et al. | 175/19 |
| 5,709,276 | | 1/1998 | Lee | 175/122 |
| 5,778,991 | * | 7/1998 | Runquist et al. | 175/73 |
| 5,794,719 | * | 8/1998 | Holloway | 175/73 |
| 5,810,101 | * | 9/1998 | Caraway, Jr. et al. | 175/162 |
| 5,950,743 | * | 9/1999 | Cox | 175/73 |

FOREIGN PATENT DOCUMENTS

| | | |
|---|---|---|
| 19732532 | 2/1999 | (DE) . |
| 0223575 | 5/1987 | (EP) . |

* cited by examiner

*Primary Examiner*—Brian L. Johnson
*Assistant Examiner*—Joselynn Sliteris
(74) *Attorney, Agent, or Firm*—Jacobson, Price, Holman & Stern, PLLC

(57) ABSTRACT

A directional drilling apparatus can be used in confined spaces or utilized in locations close to obstacles such as fences, houses, buildings, etc. A drill head is pushed forward or advanced. The drill head is of a design which provides a large amount of forward thrust for the size of the actuating unit and the drilling apparatus. The drilling apparatus is articulated from a source of power such as a prime mover and thus can be used in confined spaces.

18 Claims, 12 Drawing Sheets

DIRECTIONAL DRILLING APPARATUS

This application is a Continuation of PCT application PCT/NZ/98/00055, filed May 8, 1998, now WO 98/50667.

TECHNICAL FIELD

This invention relates to directional drilling apparatus, in particular but not solely to directional drilling apparatus which can be used in confined spaces or utilised in locations close to such obstacles such as fences, houses, buildings, etc.

BACKGROUND OF THE INVENTION

It is known to provide directional drilling devices which provide directional drilling by means of a drilling head which has an angled cutting or drilling device thereon, the angled device being monitorable in respect to its orientation about the axis of the drill. Change in direction of the drill is achieved by ceasing or preventing rotation of the drill bit when said angle device is in a desired orientation and then pushing forward the drill such that the angled device causes the drill to deviate from its current course. Drilling can then be recommenced with the drill head being pushed forward in the desired new direction.

Directional drilling (also referred to as boring, thrusting and horizontal directional drilling (HDD) is a technology which allows services such as power cables, ducts, water pipes, gas lines, drainage pipes, etc, to be placed underground without the need to cut open the ground surface as is required in cut and cover methods. The drill gains its directional ability through the use of an angled steering blade on the drill head. Immediately behind the drill head is a transmitter (sonde) which relays information to an above ground operator, such information may include how deep the drill head is, the direction in which the drill is heading and the orientation of the drill head such as the angle it is pointing up or down.

Such devices are normally bulky and incorporate means to rotate and push forward or advance the drill bead as well as means to rotate it. It is also known to provide means to extend the drill such as a set of rods which are screwed into each other to provide additional length to the drill. The power requirement of such a device are somewhat high and as these devices incorporate the source of power the devices are large. This limits the use of the device in that it is common for drilling to be required substantially horizontally or parallel to the surface of the ground from a distance beneath the surface of the ground. Thus since the abovementioned device must rest on ground level the drill must be angled in from the surface of the ground such that it levels off at the required depth. The drills as aforementioned are of course flexible to some degree however flexibility is limited therefore to the angle at which the drill enters the ground. This means that the drilling unit itself must be positioned some distance back from the point at which the level drilling commences. Obviously this is inconvenient and may in some cases limit drilling. It may in other cases mean that neighbouring land must be encroached upon and as the ultimate length of the drill usable by such a device is limited, the length of useful drilling may also be somewhat lirmited. There is also a need for apparatus which can be used in situations when the pit or hole that is possible or preferable is somewhat smaller than the abovementioned apparatus. For example it is often the case when drilling under a road that the grass strip or verge beside the footpath is very narrow. It would be useful to have drilling apparatus which can be used in a pit which can be dug in this grass verge without having to remove or disturb the footpath or road. However a drawback of such a drilling apparatus could be that the drill rods utilised would also have to be relatively compact. This would limit the efficiency of drilling as the drill requires the attachments of drill rods one behind the other.

There is therefore a need for drilling apparatus which can be used in a configuration in which longer drill rods can be utilised therefore the apparatus itself is long but can be converted to a form in which the drilling apparatus itself is more compact.

BRIEF SUMMARY OF THE INVENTION

In a first aspect the present invention consists in directional drilling apparatus comprising:

a directional drill head (that is a drill head whose direction of advancement can be controlled by a user);

an extendable drill;

means to rotate said extendable drill and drill head;

means to advance said extendable drill and drill head such that said drill moves in the direction of said directional drill head;

characterised in that said means to advance and rotate said drill and directional drill head are unitary and are capable of being articulated from a prime mover or source of power such that said unitary unit can be articulated relative to said prime mover or source of power.

Preferably said unitary unit can be adjusted in size as can, preferably, said extendable drill.

Preferably means are provided to monitor the location of said directional drill head.

Preferably said means are provided to monitor the orientation (and hence advancement direction when not rotating) of directional drill head.

Preferably said prime mover or power source is a digger or excavator.

Preferably said directional drilling apparatus is powered by said prime mover.

Preferably said directional drilling apparatus is powered by power transferred by hydraulic means.

In another aspect the present invention may broadly be said to consist in directional drilling apparatus comprising a drill head where direction of advancement can be controlled by the user;

an extendable drill;

means to rotate and advance said extendable drill and drill head, said means capable of advancing said drill and drill head without rotation such that the direction of advancement of said directional drill head can be controlled;

characterised in that said directional drilling apparatus can be held from a remote location.

Preferably said means to advance and rotate said drill and directional drill head are a unitary unit.

Preferably said unitary unit can be adjusted in size as can, preferably, said extendable drill.

Preferably said adjustment in size is by means of removing part of said unit. Alternatively said unitary unit is telescopic.

Preferably said powering of said directional drilling apparatus is from a prime mover such as a digger or excavator.

Preferably said directional drilling apparatus are articulated from said prime mover.

Preferably said means are provided to monitor the orientation and hence advancement direction when not rotating the directional drill head.

In another aspect the present invention may broadly be said to consist in:

an extendable drill;

means to rotate said extendable drill and drill head;

means to advance said extendable drill and drill head such that said drill moves in the direction of said directional drill head;

characterised in that said means to advance and rotate said drill and directional drill head are unitary and are capable of being articulated from a prime mover or source of power such that said unitary unit can be articulated relative to said prime mover or source of power when articulated from a prime mover.

Preferably said unitary unit can be adjusted in size as can, preferably, said extendable drill.

Preferably said adjustment in size is by means of removing part of said unit. Alternatively said unitary unit is telescopic Preferably means are provided to monitor the location of said directional drill head.

Preferably said means are provided to monitor the orientation of directional drill head.

Preferably said prime mover or power source is an hydraulic digger.

In yet another aspect, the present invention may broadly be said to consist in a method of directional drilling comprising providing as a unit means to rotate and advance or push directional drill head, means to power said unitary device, characterised in that said unitary device can be articulated relative to said means to power said device.

Preferably said unitary device can be adjusted in size as can, preferably, said extendable drill.

Preferably said adjustment in size is by means of removing part of said device.

Alternatively said unitary device is telescopic.

In yet another aspect, the present invention may broadly be said to consist in directional drilling apparatus as described in any of the preceding paragraphs wherein stabilising means are provided which under control of an operator can be actuated to bear against the interior and opening of a pit, or excavator blade or other solid object, thus stabilising the drilling apparatus.

In yet another aspect the present invention may broadly be said to consist in drilling apparatus as herein described wherein actuating means are provided to enable the sideways cant of the drilling apparatus to be adjusted by user.

Accordingly in another aspect the present invention may broadly be said to consist in directional drilling apparatus comprising:

a directional drill head (that is a drill head whose direction of advancement can be controlled by user);

said drill head being attached to an extendable drill;

means to rotate said extendable drill and drill head;

actuating means mounted on or adjacent said means to rotate said extendable drill, said actuating means oriented such when actuated a thrust is provided in the forward direction, that is in a direction towards the drill head;

second actuating means, said actuating means being attachable to said extendable drill and capable of providing a forward thrust to said extendable drill;

characterised in that the drill head is advanced in the following manner, first and second actuating means are placed in a non-actuated state; the actuating means are then placed in a state of actuation; thereafter said second actuating means are placed in a state of actuation, thereafter said actuating means returned to a state of non-actuation.

Preferably said actuation means comprises a pair of actuating devices substantially parallel to each other.

Preferably said actuation means and said second actuation means comprise an hydraulic ram.

Preferably said second actuation means includes means to selectively hold said drill and thereby thrust forward.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples.

BRIEF DESCRIPTION OF THE SEVERAL VIEWS OF THE DRAWING(S)

Preferred forms of the present invention will now be described with reference to the accompanying drawings in which;

FIG. 1 shows directional drilling apparatus according to a preferred form of the present invention. The directional drilling device is articulated from a prime mover or other source of power 2. Such articulation may be achieved by means of a linkage arrangement 3. Suitable linkage arrangements being obvious to those skilled in the art to which the invention relates. The present invention provides for the advancement of a drill rod 7 in a desired direction. The advantage of the present invention over the prior art ("prior art" will be described shortly) is that the useful length 5 of the drill rod 7 is greater than that of the prior art as it is easier to commence drilling at the level required. The provision of a relatively small hole 4 allows the apparatus 1 to be placed at or near the desired drilling depth;

FIG. 2 shows a prior art arrangement in which the drill rod 7 is advanced by a unit 10. Such a unit incorporates a source of power and means to rotate and change direction of the drill rod 7 together. Such a unit is obviously bulky and the angle 11 which the drill must enter the ground limits the useful length 5 of the drill rod 7;

FIG. 3 shows a drill head 20, such a drill head incorporated into the present invention. Such drill heads are known in the art to which the invention relates, the prime function of such a drill head is that when it is rotated to the appropriate direction it advances in a substantially straight manner. However as the drill head 20 has an angled cutting blade 21 at the cutting surface thereof, if the rotation of the drill head 20 is stopped and the drill head itself pushed forward in the direction labelled 22 the drill head 20 changes direction along that indicated by 23. Rotation of the drill head thereafter may be commenced allowing the drill to advance in its new direction, such known drill heads incorporate means by which an operator or user can ascertain the orientation of the angled blade 21. The orientation can of course be varied by means of rotating the drill head 20. Once the drill head 20 is in the desired orientation it can be advanced thus changing the direction of the drill;

FIG. 4 shows a directional drilling apparatus according to a preferred form of the present invention. Such a device incorporates means 30 to rotate the extendable drill and drill head 7 and 20. Such apparatus also incorporates means to advance said extendable drill and drill head such that the direction of directional drill head can be varied. The means to rotate said drill rod 7 may comprise means to grip the outside of said drill rod 7 and rotate it. Means to rotate and advance said drill rod 7 may comprise articulated means to push forward the drill preferably using any means to grip the outside of the drill rod 7 provided by the means 30 to rotate the drill;

FIG. 5 shows a specially preferred form of the present invention in which actuators are provided to increase the stability of the drilling apparatus 1. In use, this preferred form of the apparatus is attached to the prime mover or digger by means of a quick fit bucket fastening 54. A bearing 57 is provided to allow for 360°±80 rotation of the drilling apparatus 1. An actuator 56 is provided to allow for the sideways cant of the drilling apparatus 1. The stabilizing surfaces 50, 51 and 52 are extendable when the actuators for example, hydraulic actuators are extended, the stabilising surfaces 50, 51 and 52 extend and bear against the internal surfaces of the hole 4 or they may extend against a digger blade, wall or other suitable surface or device, enabling additional stability to be provided and thus greater accuracy in drilling. In other forms of the invention the stabilisers may simply comprise flat plates, however they may be textured to provide additional grip, or, in preferred forms of the invention they may have a series, for example, of three spikes to increase the "bite" of the stabilisers;

Figure 10:
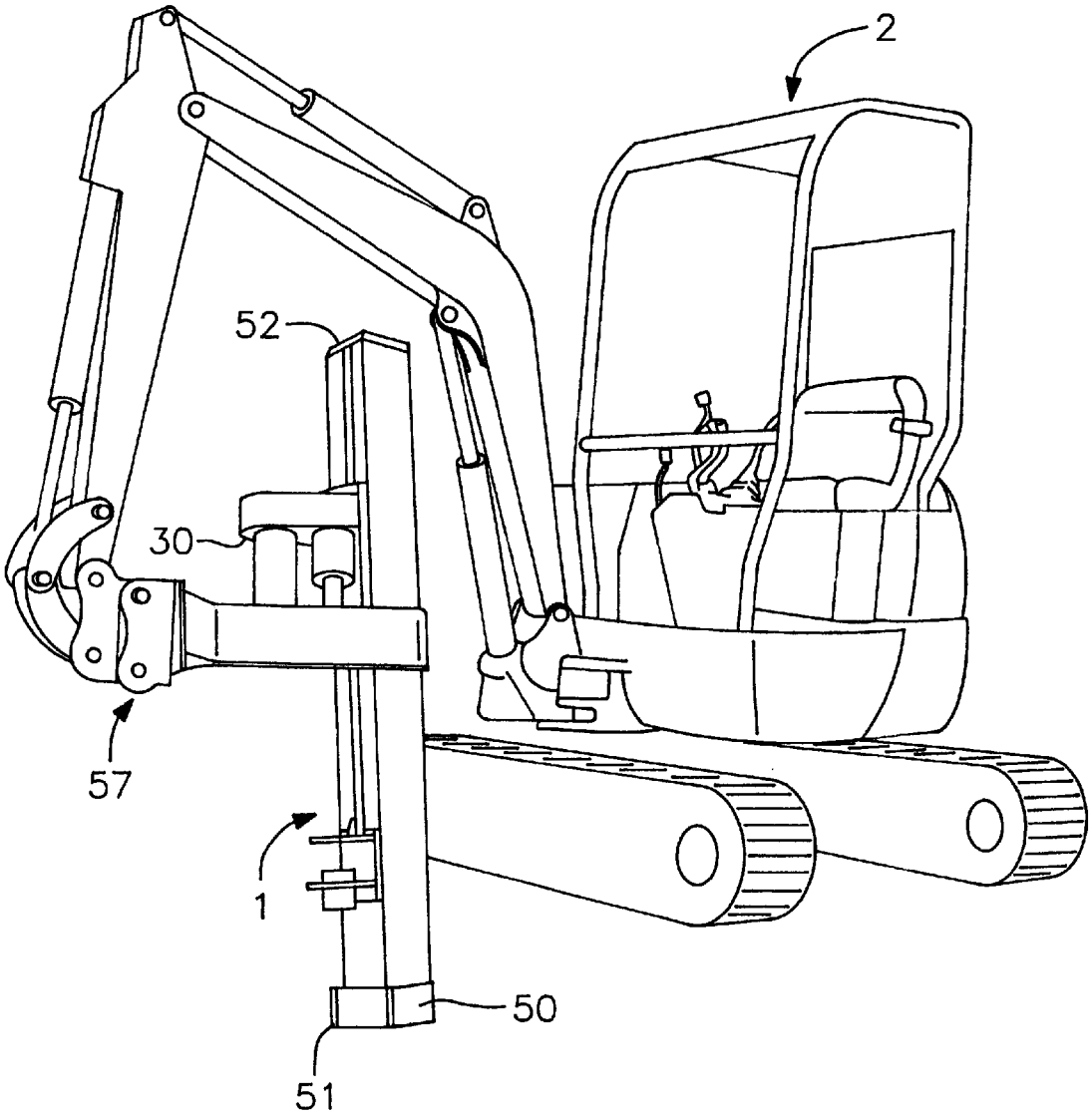
Figure 11:
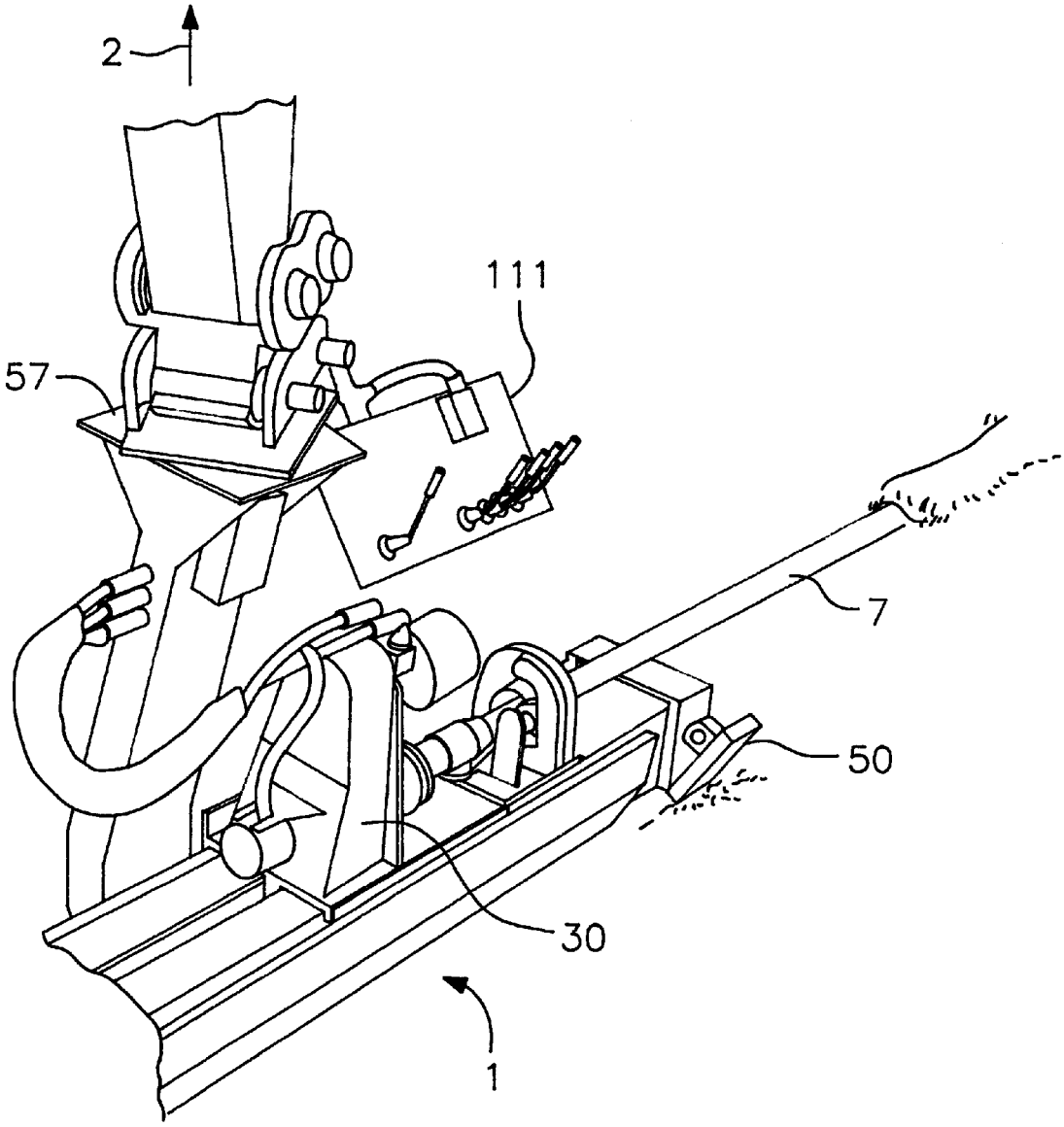
Figure 12:
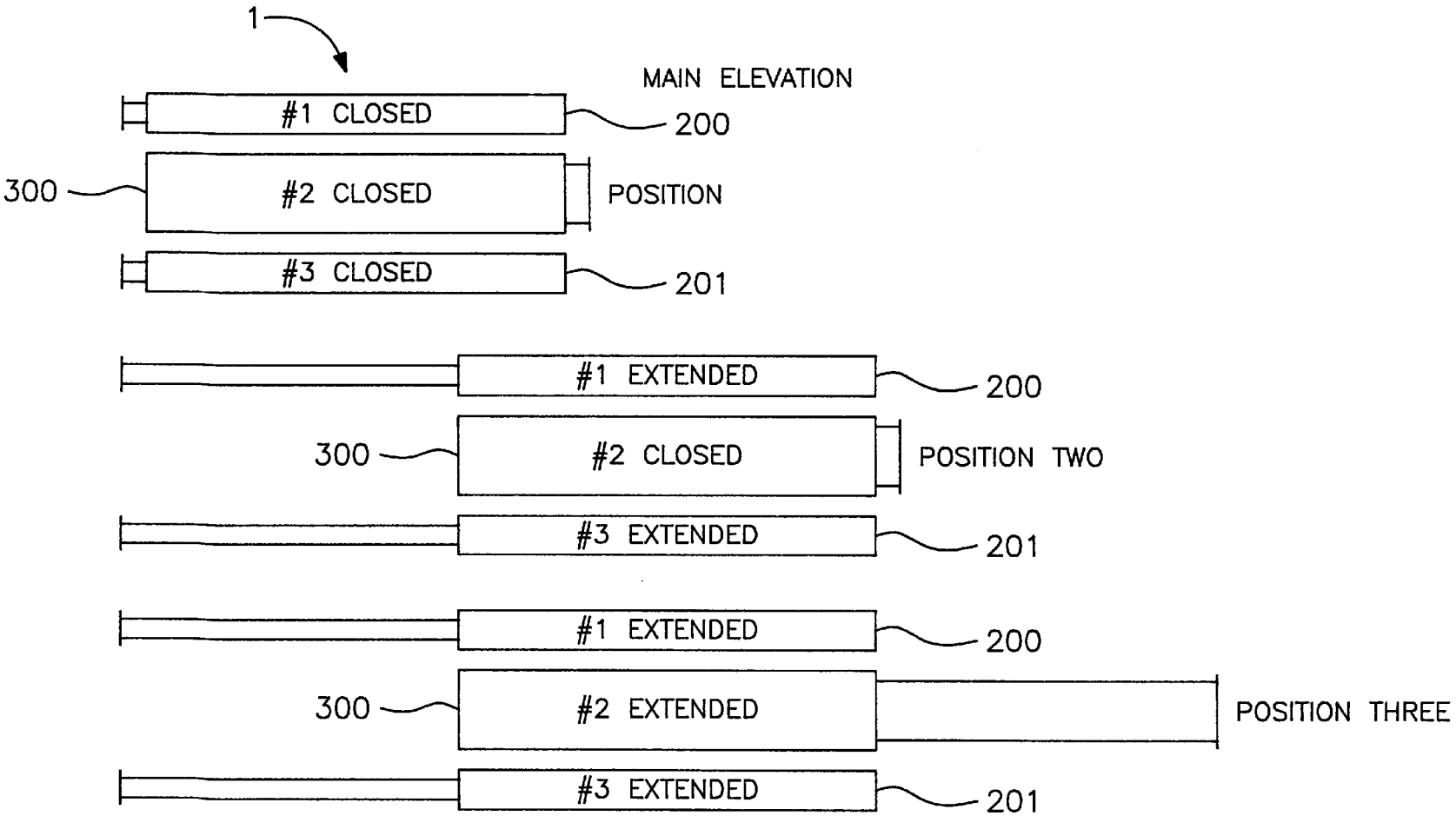
Figure 13:
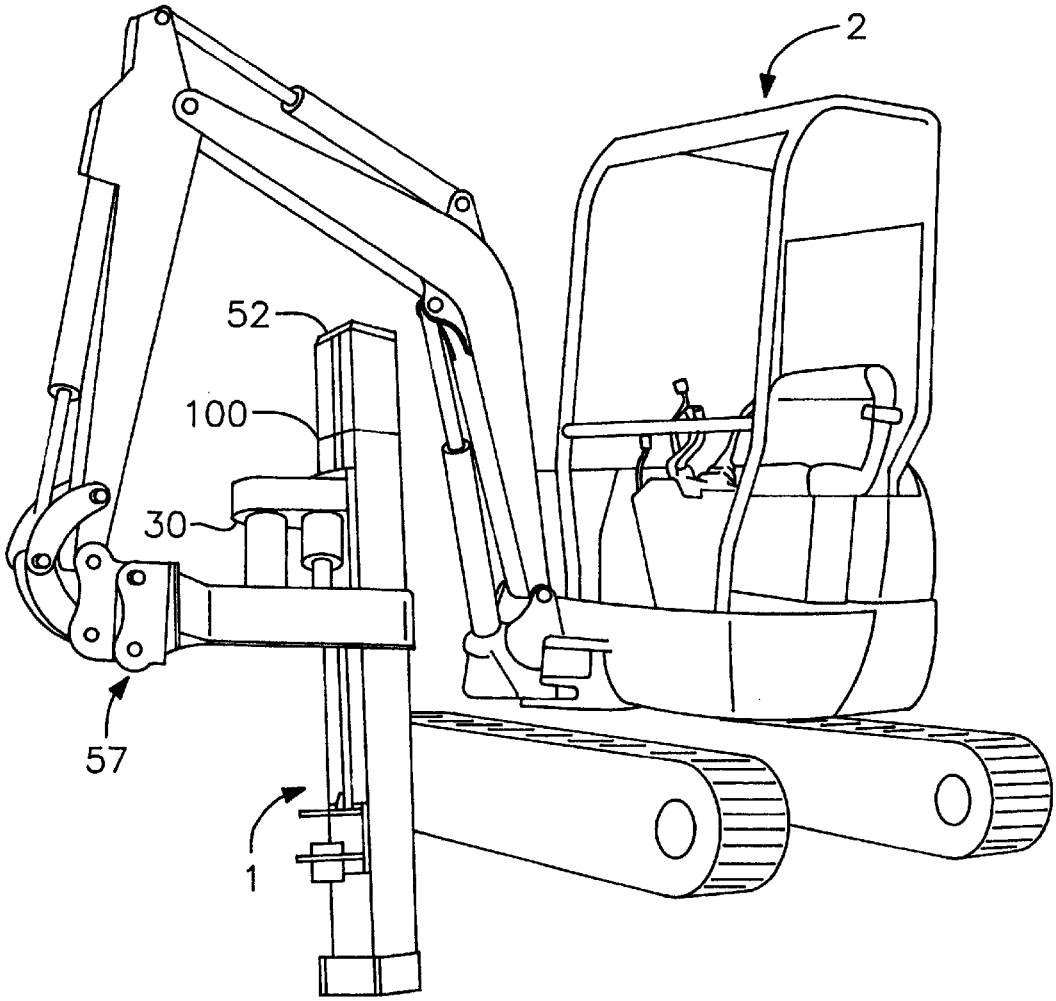

FIG. 10 shows a perspective view of directional drilling apparatus 1 according to a preferred form of the present invention, said directional drilling apparatus 1 being attached to a prime mover 2 by means of an articulated arm;

FIG. 11 shows a partial perspective view of directional drilling apparatus 1 according to a preferred form of the present invention showing the drill rod 7 entering the ground, there also being shown a console 111 for an operator;

FIG. 12 shows a diagrammatic view of the thrust sequence of actuating devices 200 and 201 and second actuation device 300 according to a preferred form of the present invention, those skilled in the art to which the invention relates will realise that a variety of actuating devices such as hydraulic or air rams can be utilised. The stabilizing surfaces 50, 51 and 52 of the actuating devices maybe frictionally enhanced by means for example roughening or spikes; and FIG. 13 shows a perspective view of a preferred form of the present invention where the unitary unit is adjustable in length.

Figure 14:
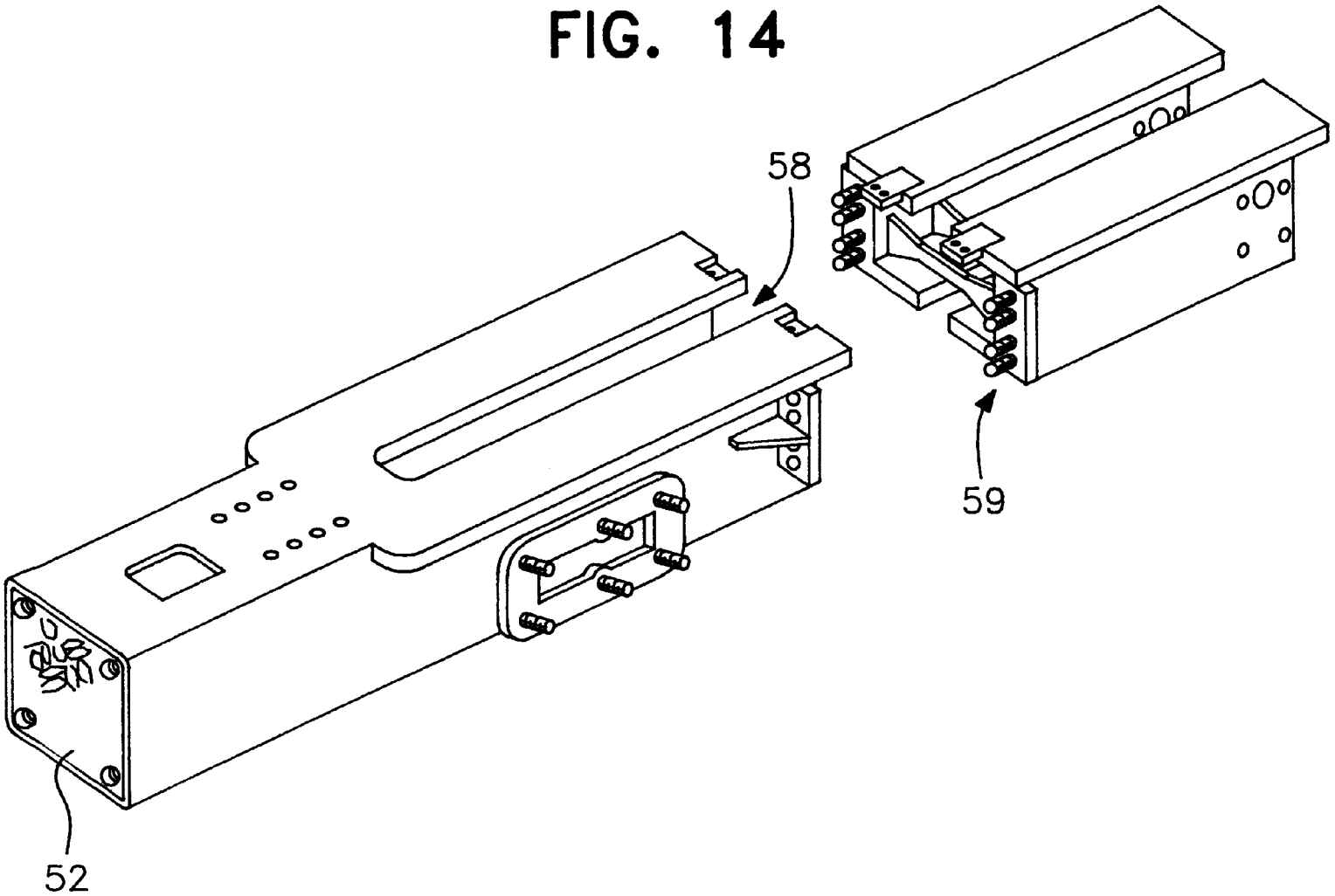

FIG. 14 is a preferred embodiment of the drill body 1.

With reference to FIG. 14 there is shown a two part drill body wherein the parts are able to be bolted together by the use of a sufficient number of bolts 59. In order to allow for longer drill rods to be used in the apparatus of the present invention at least one additional piece can be added to lengthen the drill body. This then allows for a longer distance of travel of the drill by a means 30 to be provided. Should a shorter drill body be desired or required, perhaps as a result of confined space, such extension portions can be removed. Additional portions of the drill body are provided to the main body so as to provide an extension of the slot 58 which provides stability and travel for the drill driven by means 30.

DETAILED DESCRIPTION OF THE INVENTION

Preferred forms of the present invention provide directional drilling apparatus 1. Said directional drilling apparatus as articulated are known in the art to which the present invention relates 3 from a prime mover or other source of power 2. The source of power or prime mover 2 is preferably but not necessarily easily moveable.

In preferred forms of the present invention, prime mover 2 provides power and perhaps control of the directional drilling apparatus 1 and in other preferred forms the power is provided by means of a hydraulic circuit or connection. Such connections will be obvious to those skilled in the art to which the invention relates.

The apparatus itself may comprise means 30 to rotate the drill rod 7. Such means may comprise a hydraulic motor and may incorporate jaws or clamping devices which hold the outer surface of the drill rod 7.

The directional drilling ability of a drill is achieved through the use of an angled steering blade on the drill head. A transmitter relays information to the operator above ground. Information transmitted may consist of a variety of types such as how deep the drill head is, the direction in which it is heading, the orientation, ie angle up or down of the drill head. This information is used by the operator to steer or control the drill. For example if the operator requires the drill to steer to the right to avoid an existing underground service the aboveground locator operator would instruct the drill operator to rotate the drill head to 3 o'clock and push (thrust) the drill head forward which will cause the drill to flex and head to the right. Once the drill head is heading in the desired direction and the drill head is required to track in a straight direction, the drill operator spins or rotates (a combination of pushing and rotating) the required distance until another change of direction is required. The use of a combination of spinning and pushing or thrusting and rotating makes it possible to steer under, over or around obstacles and arrive at the desired end point with a great deal of accuracy. The level of accuracy is of course dependant upon the ground conditions encountered.

Once the drill head is at its end point, for examples drilling may have occurred from one side of the road to the other, the drill head would ordinarily be removed and a cutter and/or packer attached to the drill or drill pipe or string with the service, for example power cable, duct, water pipe, gas line or drainage pipe attached. The drill or drill rods would then be pulled out of the ground while the drill is rotating, thus giving the cutter and/or packer a cutting action in allowing a hole of sufficient diameter to be formed for the pipe or cable duct line or service to be installed.

Preferred forms of the present invention can be used in particular in residential areas where the distance required to be drilled is often no more than 100 meters. Access to the site is often difficult and it is quite often the case that there is no lead-in room. That is, it is often not possible to move a great distance back from the initial entry point in order to provide access to the required depth of the drill.

Drills according to these preferred forms of the invention can be of a compact size and this can increase the number of sites which can be used. In particular drills according to preferred forms of the present invention can be launched both up and down hill. At least some preferred forms of the present invention can be set up to drill at right angles to a road thereby limiting the disruption to traffic.

One example of the present invention generates 800 pounds of thrust and approximately 10,500 pounds of pull-back from an 18 horse power source.

Preferred forms of the present invention have a drive mechanism which utilises no thrust chains, cogs or pulleys. This limits the amount of maintenance required.

Preferred hydraulic pump forms of the invention utilise a fluid supply which comprises a main pressure water source such as a garden hose.

As mentioned previously, at least preferred forms of the present invention can be launched above or below ground pointing up or down. Up to ±80 degrees of launch angle are possible.

In preferred forms of the present invention the unitary drilling apparatus itself can swivel through 360°±80 when utilised with an excavator or prime mover with an ability to rotate through 360°±80 and the ability to offset the boom of said excavator a great deal of flexibility is provided.

In preferred forms of the present invention, the unitary drilling apparatus is attached or attachable to a prime mover or excavator or digger. This means that a user requires less specialised equipment and can lower costs.

As described earlier, to control the direction of the drill rod 7 the orientation of the cutting blade 21 must be ascertained and then the drill advanced without rotation. In the preferred form of the present invention advancement is provided by means 30 to advance the drill and drill head. Such means may comprise an hydraulic ram or may utilise chains and suitable gear wheels to provide for the forward articulation of the drill.

The monitoring of the orientation of the cutting blade 21 may be achieved by radio transmission or a utilised communication means which may be provided up a hollow centre of the drill rod 7.

In preferred forms of the present invention, the drill rod 7 is made up of links of either solid bar or preferably tube. Said tube of course having a aperture there through and in preferred forms of the invention the aperture there through maybe used to provide either a cutting fluid or simply water to the drill head 20. Such provision of water facilitates the washing away of material at the drill head.

In preferred forms of the invention, the drill rod 7 is made up of links of drill which are screwed one into the other by means of a threaded portion.

Prior art directional drilling apparatus utilise links of drill rod 7 of 3½ and sometimes 4 meters in length. Preferred forms of the present invention utilise drill rod 7 which are made up of links of bar or tube which are less than 3½meters in length.

When in use, the present invention provides for the addition of additional links to the drill rod 7 by means of releasing the device gripping the outer surface of the drill retracting the means to rotate the drill, facing an additional length of drill rod 7 into the unit, attaching said additional length of drill to the preceding length of drill and then reclamping the device to grip the other surface of drill rod 7 to a rearward portion of the additional drill link.

Figure 1:
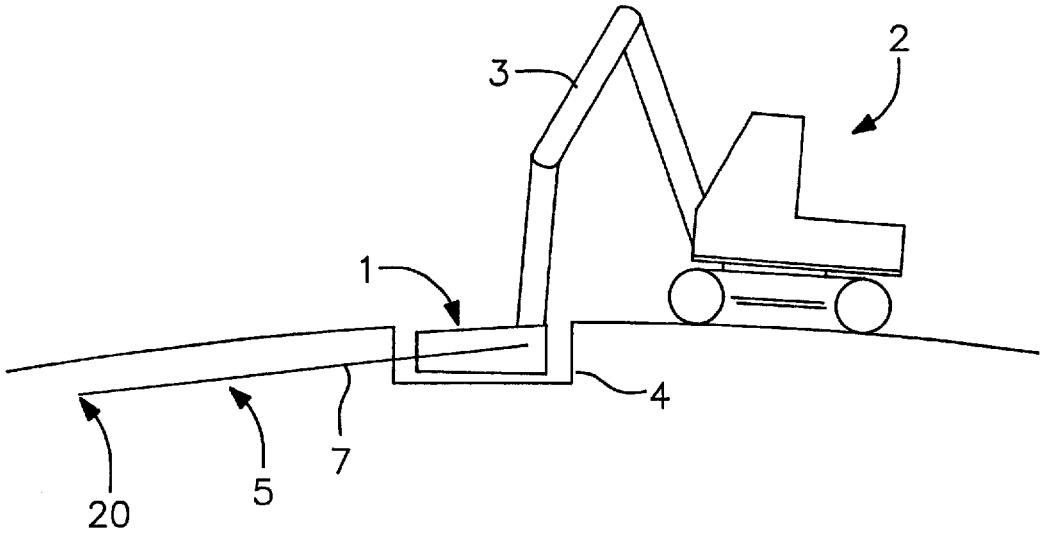
Figure 2:
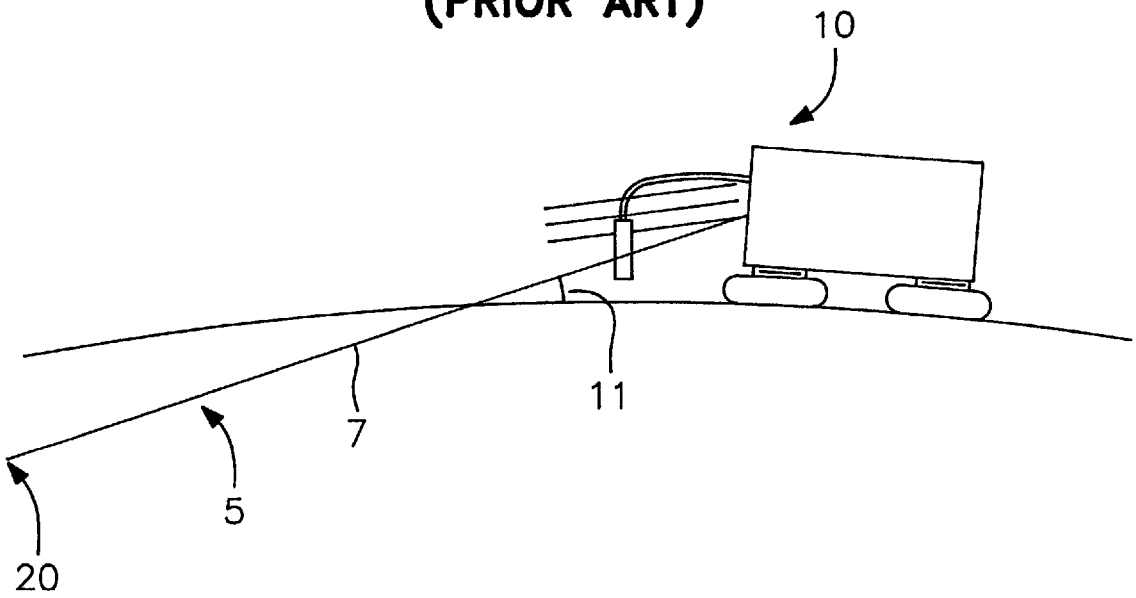
FIG. 2 (PRIOR ART)
Figure 3:
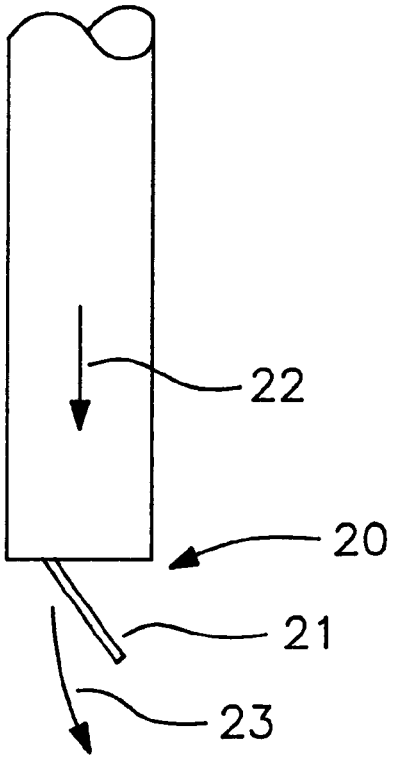
Figure 4:
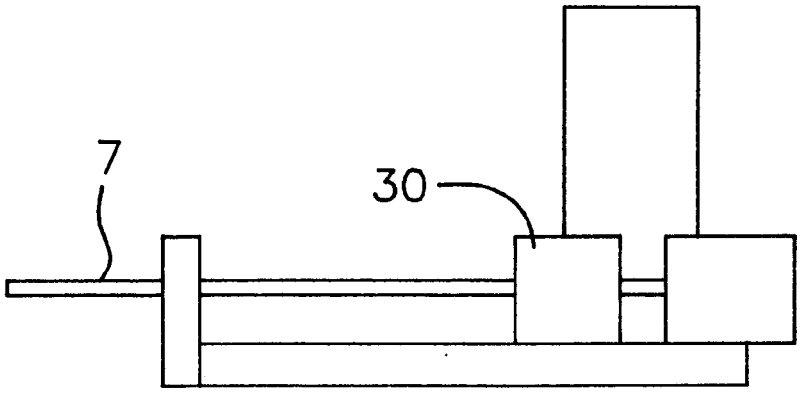
Figure 5:
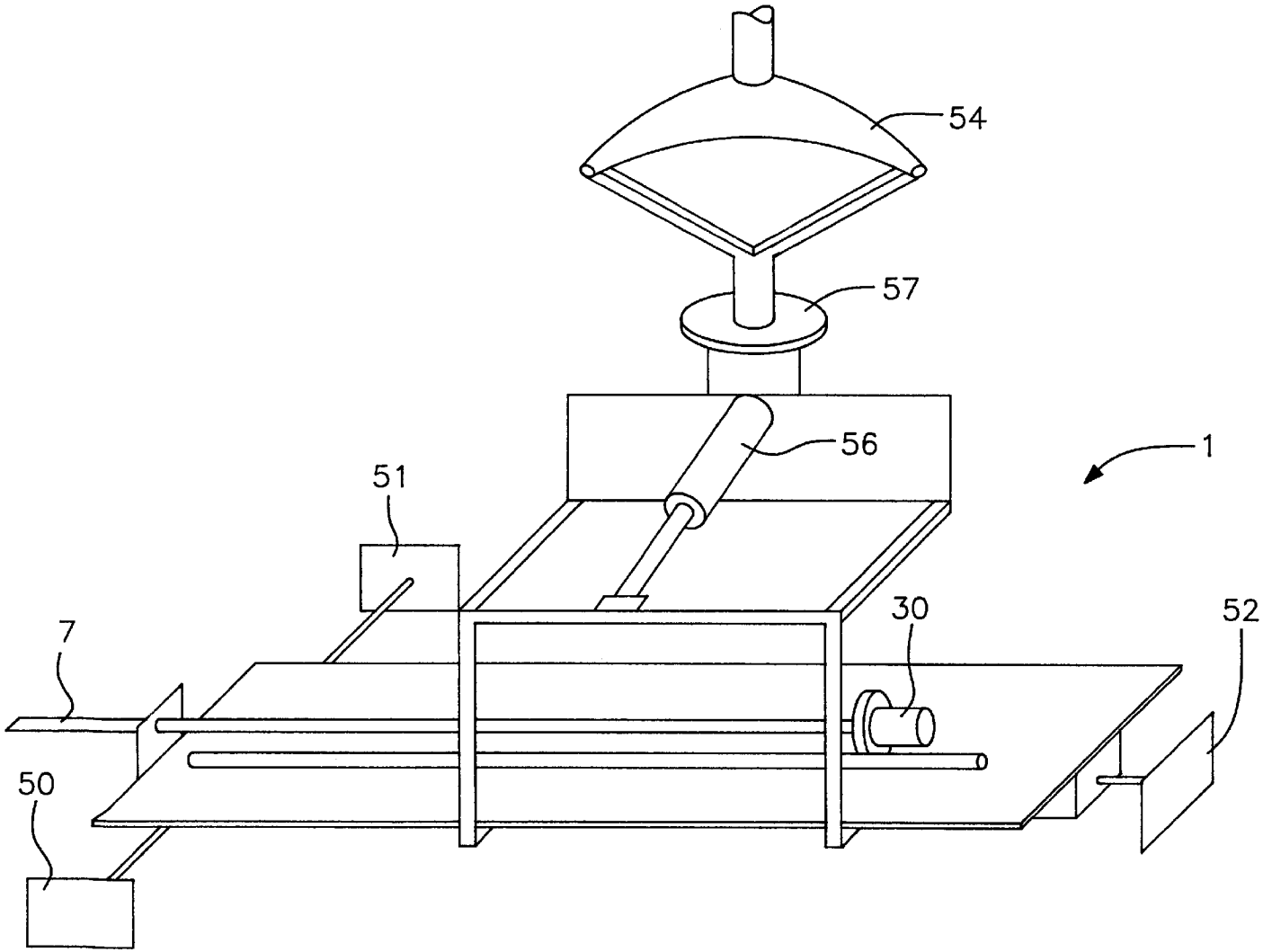
Figure 6:
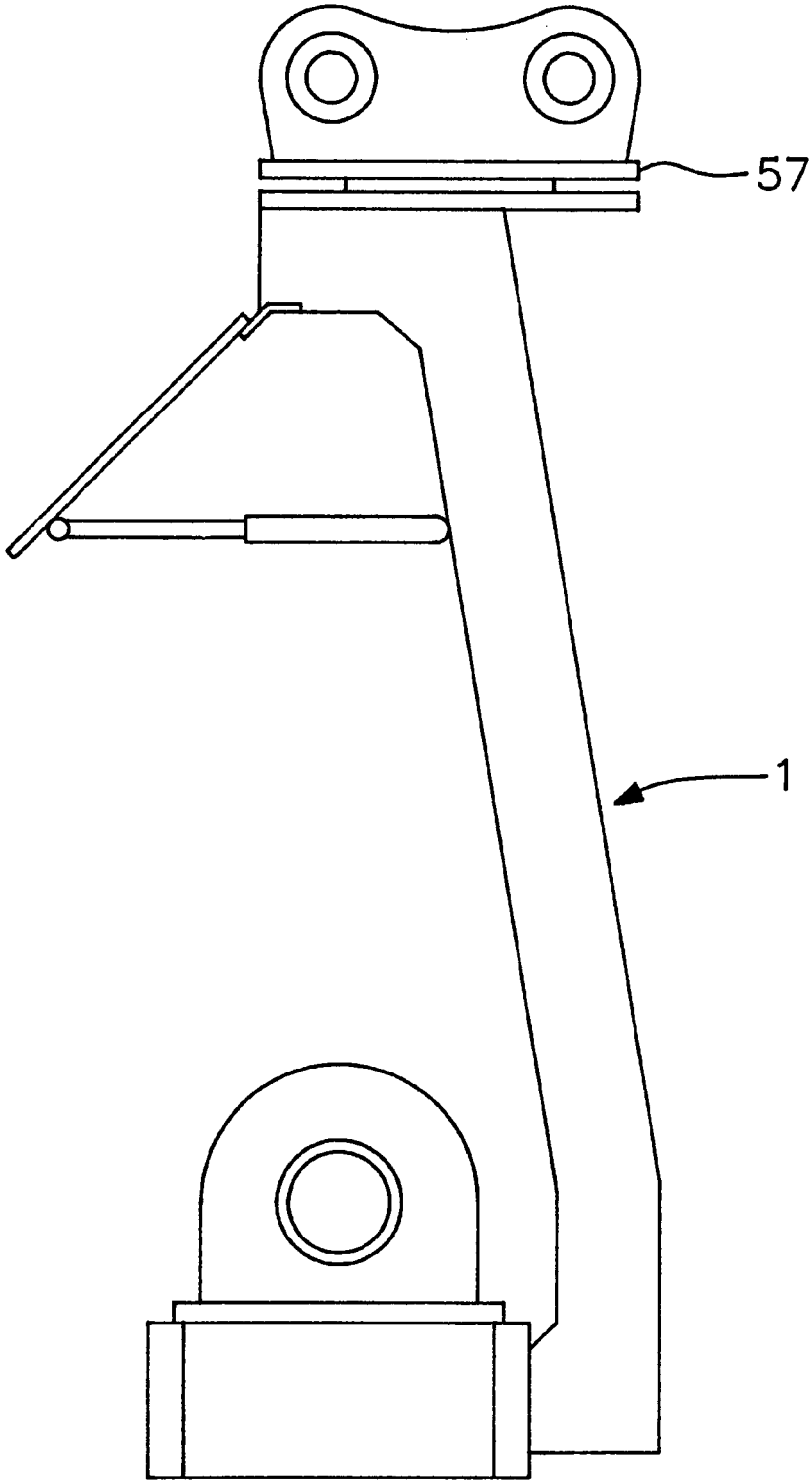
FIG. 6 shows an end elevation of directional drilling apparatus 1 according to a preferred form of the present invention.
Figure 7:
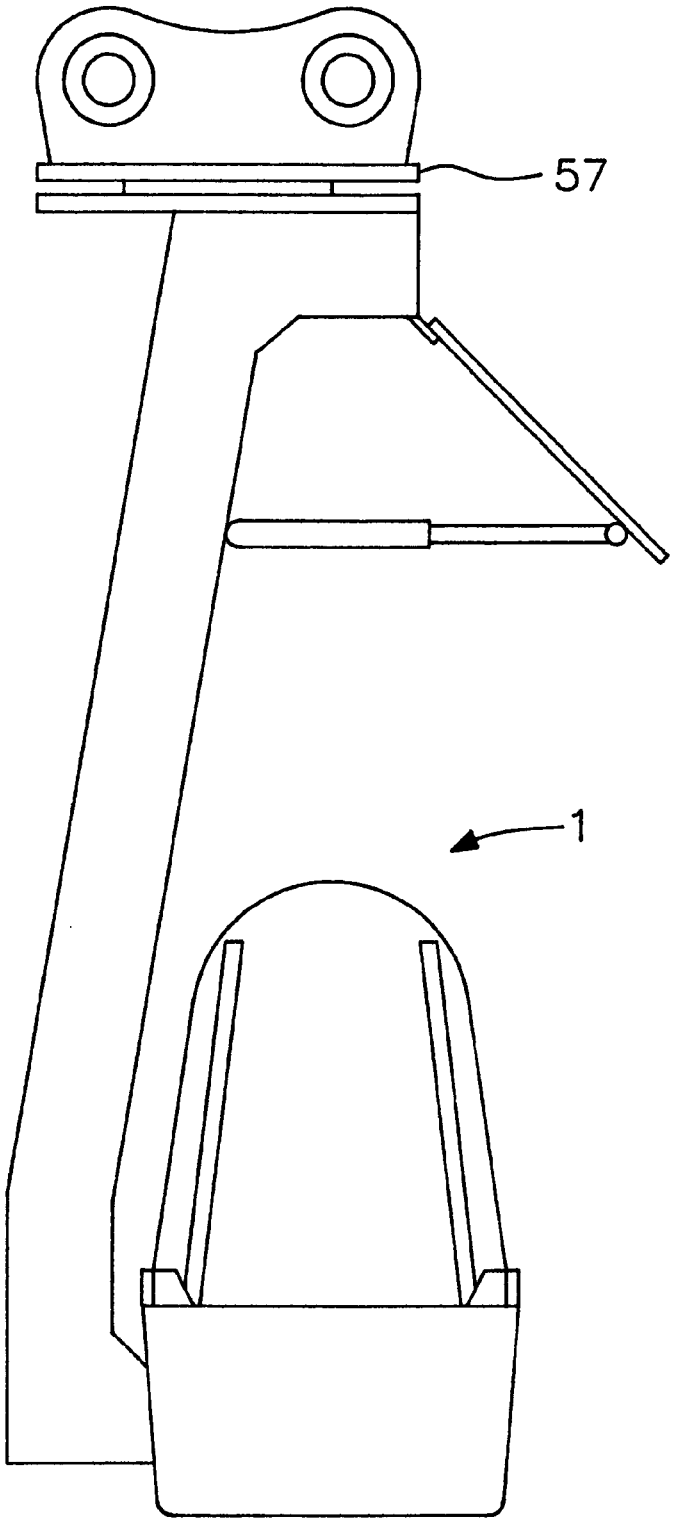
FIG. 7 shows another end elevation of directional drilling apparatus 1 according to a preferred form of the present invention.
Figure 8:
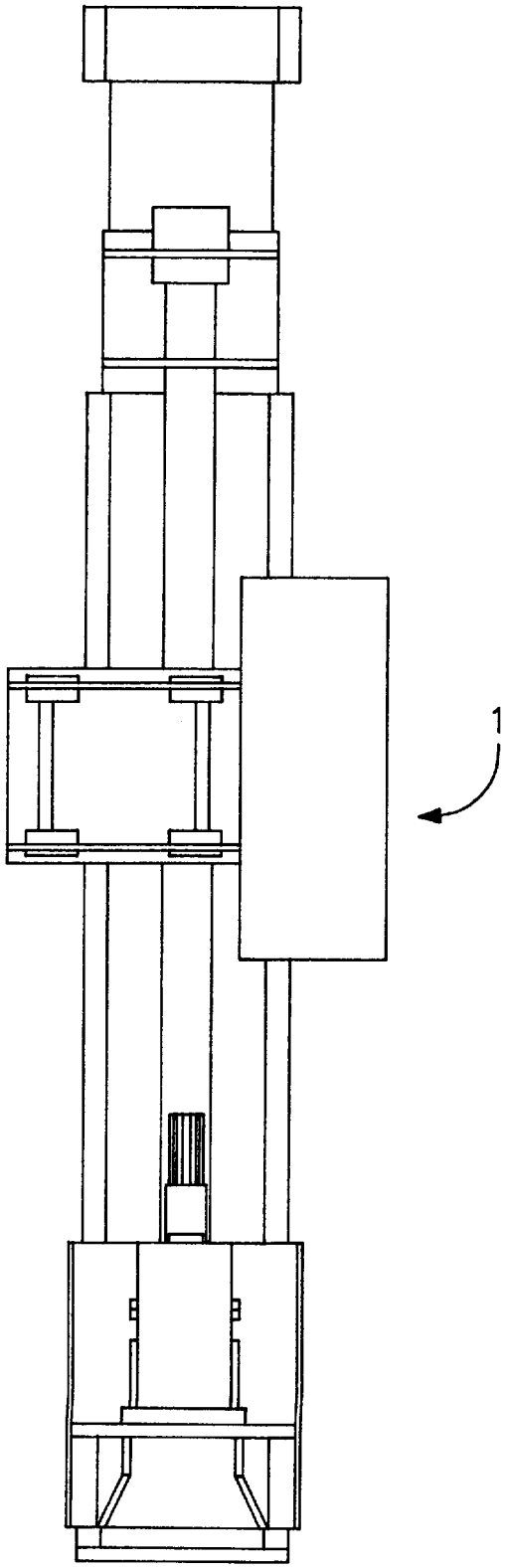
FIG. 8 shows a top view of directional drilling apparatus 1 according to a preferred form of the present invention.
Figure 9:
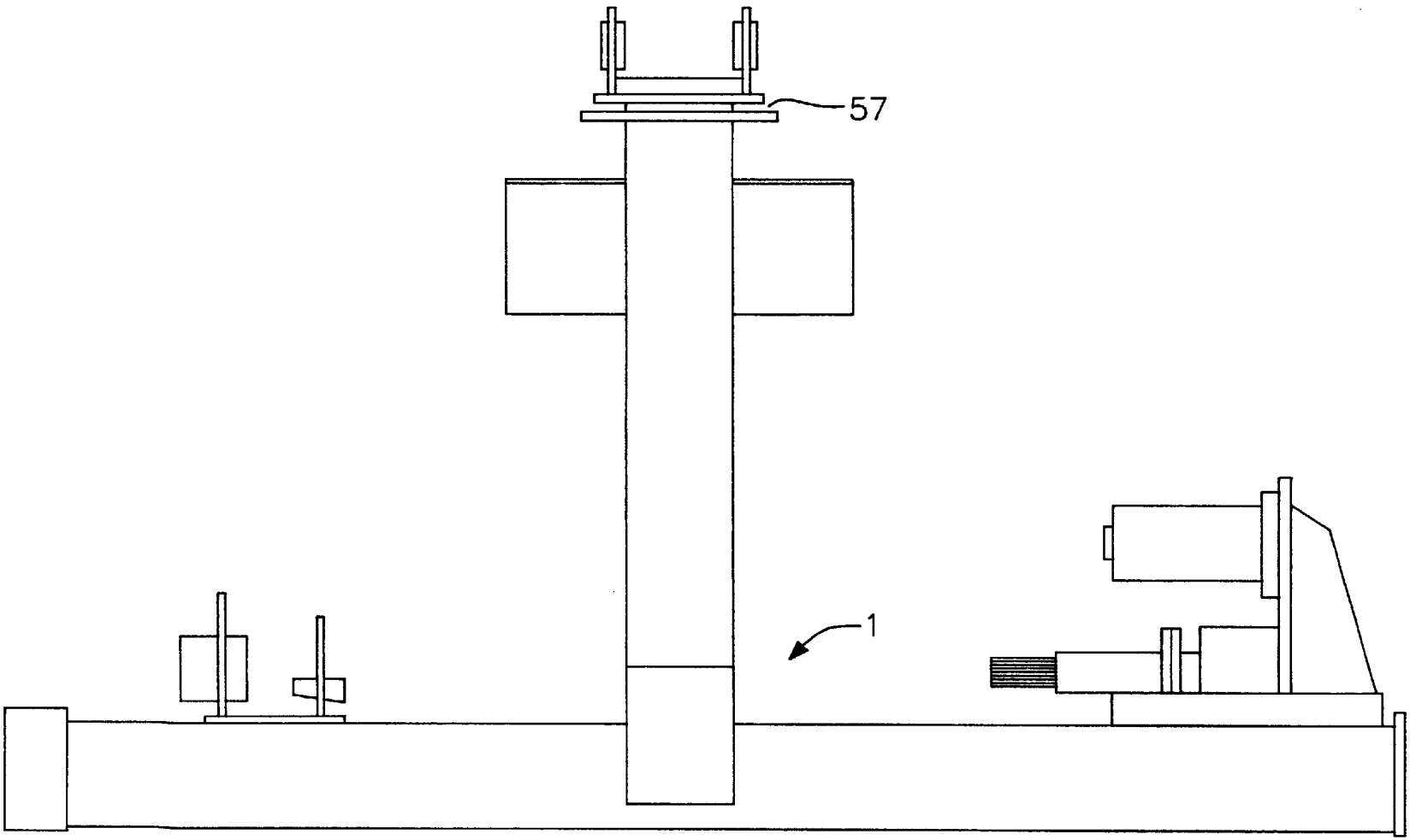
FIG. 9 shows a side elevation of directional drilling apparatus 1 of a preferred form of the present invention.

Preferred forms of the present invention, in particular the form illustrated in FIG. 5, allow for the quick fitting of the drilling apparatus 1 to the prime mover. Also present, in this preferred form of the invention is a bearing 57. This bearing allows a 360°±80 rotation of the drilling apparatus 1. Those skilled in the art to which the invention relates will realise that a variety of different bearings will be suitable.

An actuator 56 allows for the sideways cant of the drilling apparatus 1. The actuator may be hydraulically powered.

Preferred forms of the present invention utilising a floating ram system as shown in FIG. 12 provide a system whereby the actuating devices 200 and 201 are first extended, moving the device into position 2 as shown in FIG. 12; then the second actuating device 300 is extended to its actuated position or condition, bringing the device into the position 3 as shown in FIG. 12; the actuating devices and second actuating devices are then retracted, reverting the device into the position 1 as shown in FIG. 12. In position 1 a new drill rod 7 can be added and the process described above repeated.

As the drill rods are withdrawn out of the ground and the pipe, cable or other utility is being pulled into the ground the reverse of the above sequence of operation is performed.

Devices incorporating this preferred form of the present invention enable the length of the drill rod 7 to be reduced in some cases for example to 2.1 meters and use a 1 m drill rod. The weight of the device can be reduced perhaps by 30%, that is maybe down to 210 kilos giving an improved power to weight ratio. The drive train is believed to be more reliable than those utilising gears, cogs or cables.

Comparing the performance of such a system with previous technology it has been found that 8,000 pounds of thrust and 10,500 pounds of pull-back can be generated from an 18 horse power engine using the abovementioned preferred form of the present invention whereas using known drive train techniques only 7,200 pounds of thrust and 8,000 pounds of pull-back are generated from an engine rated at 55.4 horse power for example.

In the form of the invention as illustrated in FIG. 5, 10 and 11 stabilizing surfaces 50, 51 and 52 are present. Said stabilizing surfaces are advanced by means of actuators for example hydraulic actuators and bear against the internal surfaces of the hole 4. The stabilisers have the effect of locking the drilling apparatus 1 into the hole 4 thus increasing the accuracy of the drilling. The stabilizing surfaces 50, 51 and 52 are preferably remotely controllable by an operator.

As can be shown in the figures the present invention provides a unitary directional drilling device which can be placed into a small hole 4 or above ground. Thus the use of the length of drill is maximised With reference to FIG. 13, the size of the unitary drilling apparatus 1 is preferably adjustable, for example, by means of removing the portion of the drilling apparatus 1 which lies beyond the line 100. In certain forms of the invention this is done by removal of the end portion of the apparatus. Then removal of the portion of the drilling apparatus 1 beyond the line 100. The end portion is then reattached to the drilling apparatus. In this form of the invention drilling rods of the smallest size must be available to be used when the drilling apparatus is in its smaller or non-extended form.

The form of the present invention as shown in FIG. 13 provides a unitary drilling apparatus which can be adjusted as to size thereby enabling it to be used in pits or holes or situations where the fill size or larger apparatus would run into difficulties. In its smaller form the apparatus 1 utilises rods which are somewhat smaller than those utilised when it is in its expanded or larger form.

A variety of techniques can be employed to provide the multiple sizing of the apparatus 1. In the form illustrated, a piece of the apparatus is removed to enable it to function as a smaller unit. In other forms the apparatus may be telescopic with one portion of the unit 1 sliding onto or into another portion so as to provide for the size adjustment.

What is claimed is:

1. Directional drilling apparatus comprising:

a directional drill head;

an extendable drill;

means to rotate said extendable drill and drill head;

means to advance said extendable drill and drill head such that said drill moves in a direction of said directional drill head;

said means to advance and rotate said drill and drill head are a unit and are capable of being articulated from a source of power and being swivelled through at least 280°.

2. Directional drilling apparatus as claimed in claim 1 wherein said unit is less than 3.5 meters long.

3. Directional drilling apparatus as claimed in claim 1 wherein said source of power is an excavator.

4. Directional drilling apparatus as claimed in claim 1 wherein said directional drilling apparatus is powered solely by said source of power.

5. Directional drilling apparatus as claimed in claim 1 wherein said directional drilling apparatus is powered by power transferred by hydraulic means.

6. Directional drilling apparatus as claimed in claim 1 wherein stabilising means are provided which, under control of an operator, can be actuated to bear against a solid surface to stabilize the drilling apparatus.

7. Drilling apparatus as claimed in claim 1 wherein actuating means are provided to enable sideways cant of the drilling apparatus to be adjusted by an operator.

8. Directional drilling apparatus comprising:

an extendable drill having a directional drill head at a distal end;

means to rotate said extendable drill and directional drill head;

means to advance said extendable drill and directional drill head such that said extendable drill moves in a direction of said directional drill head;

said means to advance and rotate said drill and directional drill head are a unit capable of being articulated from a source of power such that said unit can be articulated relative to said source of power through at least 280° when articulated from said source of power.

9. Directional drilling apparatus as claimed in claim 8 wherein said unit is adjustable in size by removing a part of said unit.

10. Directional drilling apparatus as claimed claim 8 wherein said unit is less than 3.5 meters long.

11. Directional drilling apparatus as claimed in claim 9 wherein said source of power is an excavator.

12. A method of directional drilling comprising providing as a unit, means to rotate and advance a directional drill head, providing a source of power to said unit, and articulating said unit relative to said source of power by at least 280°.

13. A method as claimed in claim 12 wherein said unit is adjustable in size by removing a part of said unit.

14. Directional drilling apparatus comprising:

a directional drill head;

an extendable drill;

means to rotate said extendable drill and drill head;

means to advance said extendable drill and drill head such that said drill moves in a direction of said directional drill head;

said means to advance and rotate said drill and drill head are a unit and are capable of being articulated from a source of power, and stabilising means provided which, under control of an operator, can be actuated to bear against a solid surface to stabilise the drilling apparatus.

15. Directional drilling apparatus comprising:

a directional drill head;

an extendable drill;

means to rotate said extendable drill and drill head;

means to advance said extendable drill and drill head such that said drill moves in a direction of said directional drill head;

said means to advance and rotate said drill and directional drill head are a unit and are capable of being articulated from a source of power, and actuating means provided to enable sideways cant of the drilling apparatus to be adjusted by an operator.

16. Directional drilling apparatus comprising a drill head, a direction of advancement of which can be controlled by a user;

an extendable drill;

means to rotate and advance said extendable drill and drill head, said means capable of advancing said drill and drill head without rotation such that the direction of advancement of said directional drill head can be controlled;

said directional drilling apparatus being held and powered from a remote location, said means to advance and rotate said extendable drill and said directional drill head being a unit, said unit being adjustable in size by removing a part of said unit.

17. Directional drilling apparatus comprising:

an extendable drill;

a directional drill head located at a distal end of said extendable drill;

means to rotate said extendable drill and directional drill head;

means to advance said extendable drill and directional drill head such that said drill moves in the direction of said directional drill head;

said means to advance and rotate said drill and directional drill head are a unit capable of being articulated from a source of power such that said unit can be articulated relative to said source of power when articulated from said source of power; and said unit being adjustable in size by removing a part of said unit.

18. A method of directional drilling comprising providing as a unit, means to rotate and advance a directional drill head, providing a source of power to said unit, articulating said unit relative to said source of power, and adjusting said unit in size by removing a part of said unit.

* * * * *